US005795217A

United States Patent [19]

LaPlante et al.

[11] Patent Number: 5,795,217

[45] Date of Patent: Aug. 18, 1998

[54] STRESSED BURNISHER

[75] Inventors: Mark Joseph LaPlante, Walden; Thomas Edward Lombardi, Poughkeepsie; David Clifford Long, Wappingers Falls; Anton Nenadic, Red Hook; Alan Piciacchio, Hopewell Junction, all of N.Y.

[73] Assignee: International Business Machines Corporation, Armonk, N.Y.

[21] Appl. No.: 562,291

[22] Filed: Nov. 22, 1995

[51] Int. Cl.[6] ..... B24B 41/02; B24D 17/00

[52] U.S. Cl. ..... 451/313; 29/90.01; 451/340; 451/490; 451/526; 451/552

[58] Field of Search ..... 29/90.01; 451/313, 451/340, 490, 526, 552

[56] References Cited

U.S. PATENT DOCUMENTS

| | | | |
|---|---|---|---|
| 2,732,612 | 1/1956 | Hallock et al. . | |
| 3,076,254 | 2/1963 | Ricci et al. . | |
| 3,410,033 | 11/1968 | Fehrm | 451/490 |
| 3,760,660 | 9/1973 | VanArnam et al. | 81/9.2 |
| 3,952,389 | 4/1976 | Corder | 29/90 R |
| 4,185,388 | 1/1980 | Jarby | 451/490 X |
| 4,246,684 | 1/1981 | Barker | 29/90.01 |
| 4,561,214 | 12/1985 | Inoue . | |
| 4,599,187 | 7/1986 | Hey | 252/171 |
| 4,845,816 | 7/1989 | Nanin | 29/6 |
| 4,856,490 | 8/1989 | Kawase et al. | 451/526 X |
| 4,866,888 | 9/1989 | Murai et al. | 451/526 X |
| 4,991,274 | 2/1991 | Fortier et al. | 29/90.01 |
| 4,995,200 | 2/1991 | Eberhart | 451/490 X |
| 5,063,712 | 11/1991 | Hamilton et al. . | |
| 5,099,558 | 3/1992 | Wilson | 29/90.01 |
| 5,187,904 | 2/1993 | Tyler et al. | 451/526 X |
| 5,322,398 | 6/1994 | Schmidt et al. | 408/145 |
| 5,348,913 | 9/1994 | McBride et al. | 437/209 |

FOREIGN PATENT DOCUMENTS

| | | | |
|---|---|---|---|
| 0523892A1 | 7/1992 | European Pat. Off. . | |
| 3542193C1 | 11/1985 | Germany . | |
| 3834396A1 | 10/1988 | Germany . | |
| 4-191542 | of 0000 | Japan . | |
| 323254 | 8/1989 | Japan . | |
| 1-264777 | 10/1989 | Japan | 451/490 |
| 05037136 | 2/1993 | Japan . | |
| 50175641 | 7/1993 | Japan . | |
| 5-301170 | 11/1993 | Japan | 451/526 |
| 5-301173 | 11/1993 | Japan | 451/526 |
| 06013363 | 1/1994 | Japan . | |
| 2163697 | 8/1985 | United Kingdom . | |

OTHER PUBLICATIONS

R. E. Tompkins, "Deburring of Multilayer Ceramic Substrates" IBM Technical Disclosure Bulletin, V. 19, No. 2, p. 451, Jul. 1976.

*Primary Examiner*—Timothy V. Eley
*Attorney, Agent, or Firm*—Steven J. Soucar

[57] ABSTRACT

A burnisher for disassociating undesirable material from a work piece includes a wire and a burnishing medium operably associated with the wire. The flexibility of the burnisher permits forces to be generated to disassociate the burnishing medium.

21 Claims, 4 Drawing Sheets

STRESSED BURNISHER

TECHNICAL FIELD

This invention generally relates to a burnisher for removing undesirable material from a work piece and method of burnishing. More particularly, the invention relates to a cantilever burnisher for removing undesirable material from a ceramic package that receives a computer semiconductor chip.

BACKGROUND OF THE INVENTION

Semiconductor chips can be attached to a ceramic substrate using a number of techniques including wire bonding technology. In wire bonding technology, a chip is mounted in a ceramic package having a recessed cavity that can be a through cavity, i.e., the cavity extends through the entire package forming an opening therethrough. The ceramic package includes shelves with wire bond pads and pin attachment pads (collectively referred to as "pads") to which the chip is electrically connected. The packages are prepared by layering up greensheets of uncured ceramic having holes therein of varying size that when assembled define the cavity and shelves. Alternatively, the package is prepared by casting with the cavity formed or punched therein. An insert/plug is placed in the cavity to produce a properly sized cavity after exposure to high pressure, e.g., 3,000–5,000 psi, to bond and densify the ceramic. The insert is then removed.

A metal heat slug is often attached to the package after firing to enhance dissipation of the heat generated during use of the chip as compared to a standard ceramic cavity package that lacks the heat slug. The heat slug is brazed to a heat slug braze band (braze band) on an exterior surface of the package and goes over the opening if the cavity is a through cavity. Care must be taken in the alignment of the opening in the package and braze band and the shape of the package and braze band to avoid the following problems. The package should have a very low camber at the opening so that the heat slug can more easily be brazed to the package. The braze band must come completely to the edge of the package adjacent to the opening to ensure good braze fillet integrity. If the metal of the braze band does not go to the edge of the cavity, the braze fillet will not be continuous about the edge of the cavity which can result in the build up of stresses that cause cracking in the ceramic during thermal cycling of the package. Further, if the fillet is not continuous, plating solutions could be trapped between the package surface to which the heat slug is attached and the heat slug causing high stresses during subsequent processing that result in cracking of the ceramic. Therefore, it is critical that a sidewall defining the cavity be substantially perpendicular to the adjacent exterior surface of the package and that the heat slug braze band goes to the very edge of the cavity.

Sometimes when the insert is used in the fabrication of the package, some ceramic flows under the insert during densification leaving undesirable material in the form of flashing or a burr at a bottom edge of the cavity adjacent to the exterior surface. The undesirable material must be removed from the package to avoid the aforementioned problems.

Care must be taken during removal of the undesirable material to ensure that only the undesirable material is removed because if part of the sidewall is also removed, the sidewall will not be perpendicular with the exterior surface; causing the aforementioned problems. Contact with the sidewalls of the cavity should be minimized during removal because this can cause delamination of the layers and failure of the package. Further, care must be taken not to contact or contaminate the pads on the package which can damage the pads and ruin the package. The cavity usually has sharp corners from which the undesirable material must be removed that are difficult to reach.

The undesirable material can be removed by hand using a cotton swab, e.g., a Q-tip. The shortcomings of this technique include low efficiency, low reproducability, contact with the pads and internal sidewalls, possible contamination from fibers and other debris and the inability to reach into corners.

Removal using a hard broach also has shortcomings. The broach must be sized for the cavity; if the size of the cavity is slightly different, the broach will not work. The shortcomings of the cotton swab technique also exist.

Numerous packages are often fabricated in a group or "multi-up" to improve manufacturing efficiencies. For example, a group of nine packages is referred to as a 9-up which is a 3×3 matrix of packages in a single layer. An apparatus that can simultaneously remove the undesirable material from all of the packages in a group is desirable. The exact position of a package, e.g., the center of each package in a 9-up, in the matrix and the size of each cavity varies slightly from one up to the next; making simultaneous removal difficult. These variations can result in the failure to remove all of the undesirable material or, just as troublesome, removal of material from the sidewalls. If either of these events occur, the aforementioned problems can also occur.

The hard broach is not suitable for a multi-up because of alignment problems that arise due to the variation in position and size of the through cavities of the package. A foam rubber broach solves some of the alignment problems but cannot reach into corners and can contact the pads or sidewalls. Further, the foam broach is difficult to make and wears out due to rubbing against the ceramic.

An apparatus and method that remove undesirable material while maintaining the desired shape of the cavity and which do not cause the aforementioned problems are highly desirable.

SUMMARY OF THE INVENTION

The invention provides a burnisher capable of disassociating undesirable material from a work piece, e.g., a ceramic package. The burnisher removes the undesirable material so that the work piece has a clean edge to enable an attachment to a surface adjacent to the edge to come up to the clean edge.

According to the invention, the burnisher includes a flexible wire and a burnishing medium operably associated with the wire. The burnishing medium is capable of disassociating the undesirable material from the work piece.

A method of burnishing includes the steps of providing the burnisher, positioning the burnishing medium adjacent the undesirable material and flexing the burnisher to urge the burnishing medium into contact with the undesirable material.

Numerous other advantages and features of the present invention will become readily apparent from the following detailed description of the preferred embodiments, the drawings and the appended claims.

DETAILED DESCRIPTION OF THE PREFERRED EMBODIMENTS

Figure 1:
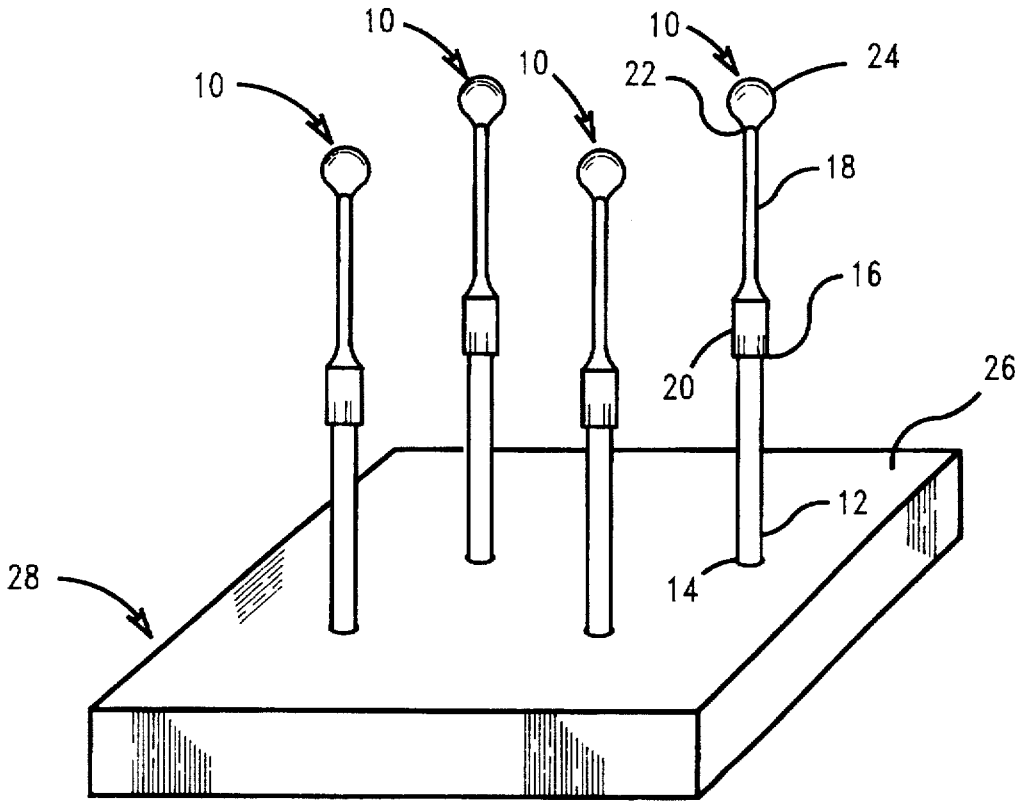
FIG. 1 is a side perspective view of burnishers of the present invention mounted on a base.

FIG. 1 illustrates a burnisher 10 of the present invention which includes a wire 12 for supporting. The wire 12 has proximate and distal ends 14 and 16, respectively. A burnishing medium 18 is operably associated with, and supported by, the wire 12. Operable association can be achieved by adhering the burnishing medium 18 directly to a surface of the wire 12. In another embodiment, the burnishing medium 18 is a separate rod, wire or the like and operable association is achieved using a coupler 20 to attach the burnishing medium 18 to the distal end 16. Adjacent the burnishing medium 18 is a lead section 22 which will pass by a work piece (not shown), e. g., a green, unfired ceramic package, before the burnishing medium 18. The lead section 22 includes a protective cover 24 for protecting the work piece from harm when the burnishing medium 18 passes thereby. Cover 24 also protects the user from getting pricked by the burnisher 10.

Figure 4:
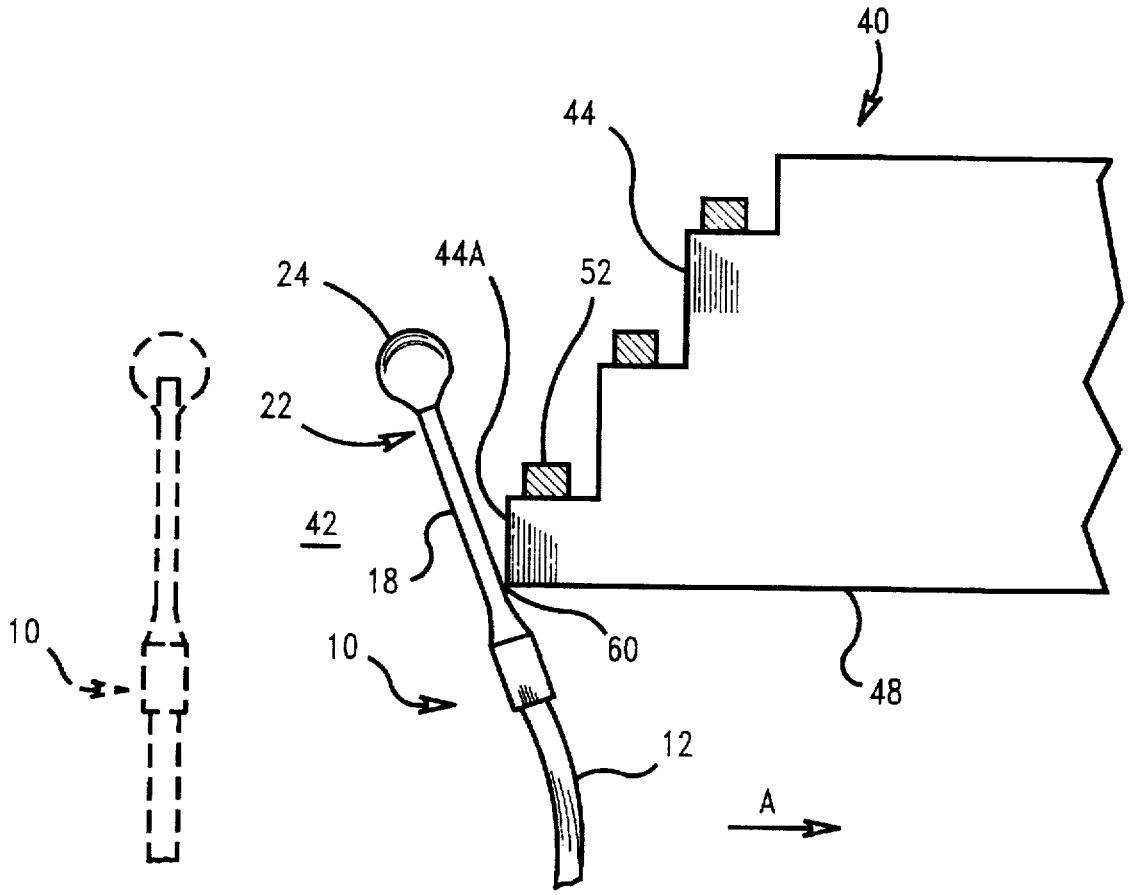
FIG. 4 is a side elevational view of one burnisher in contact with the work piece.

Multiple burnishers 10 extend from a surface 26 of a base 28 with the proximate ends 14 of the wires 12 being attached to the base 28. The wires 12 support the burnishing medium 18 in a spaced relation from the base 28. The use of multiple burnishers 10 on a base 28 is particularly useful when the packages are in a multi-up arrangement. In another embodiment, the burnisher 10 is not attached to the base (FIG. 4).

Figure 2:
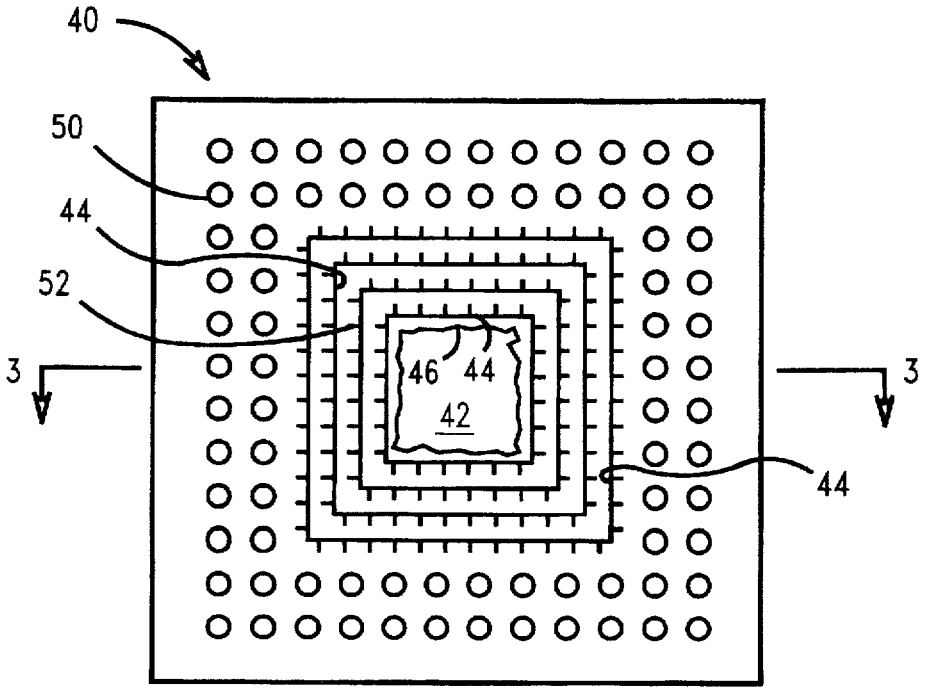
FIG. 2 is a top elevational view of a work piece on which the burnisher can be used.
Figure 3:
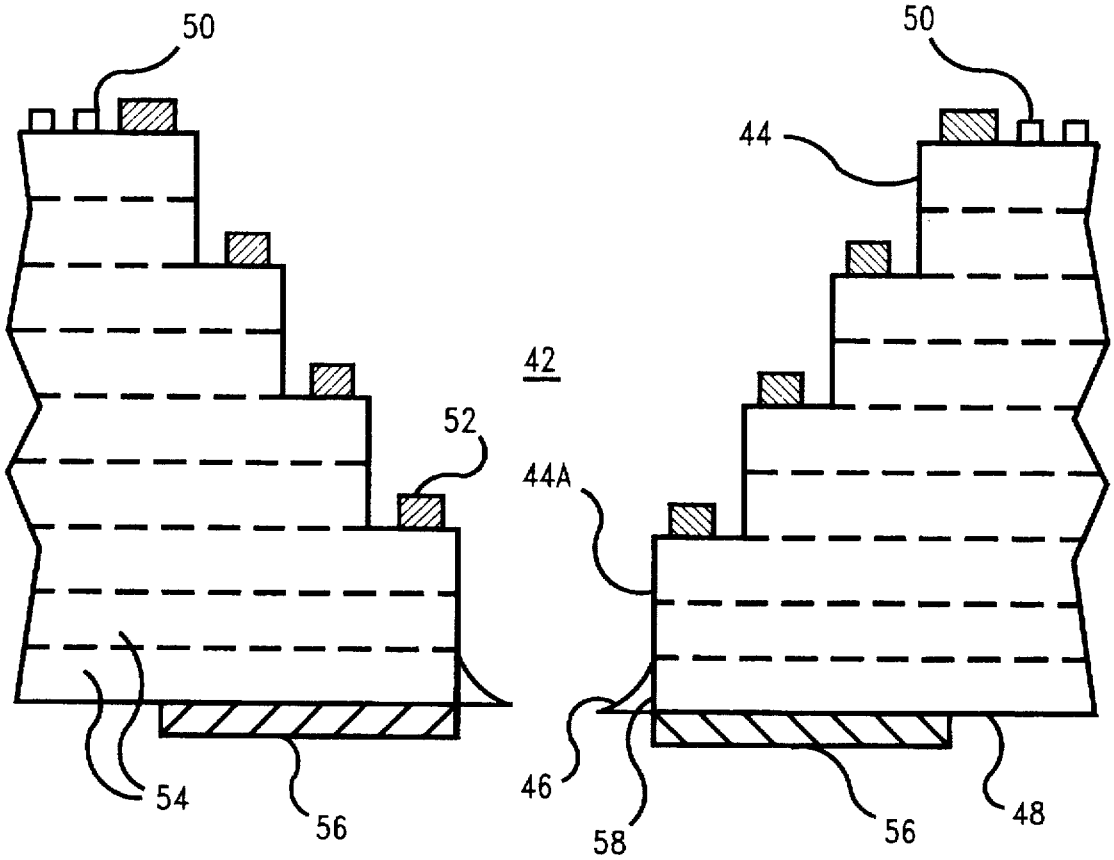
FIG. 3 is a side elevational view of the work piece take through line 3—3 of FIG. 2.

FIGS. 2 and 3 illustrate an unfired ceramic package 40 ultimately capable of receiving an integrated circuit chip (not shown) in through cavity 42. The cavity 42 is defined by sidewalls 44 of the package 40. Undesirable material 46 in the form of flashing or a burr extends into the cavity 42 adjacent an exterior surface 48 of the package 40. Pin attachment pads 50 on the package 40 provide attachment points for input/output pins that in turn provide electrical connections to a board (not shown). Wire bond pads 52 on the package 40 are positioned adjacent to the cavity 42 to provide electrical connections between the chip and the package 40.

The package 40 is produced from multiple layers 54 that are laid up and then laminated together under elevated temperature and pressure to form a substantially unitary structure. The layers 54 are shown by broken lines because they have been joined together; albeit the layers of the package 40 in this green, unfired condition can be separated by applying a sufficient force thereto. During lamination, some of the material from which the layers 54 are made is forced under an insert (not shown) used to maintain the integrity of the cavity 42 during lamination. The material forced under the insert is the undesirable material 46 which must be removed.

A braze band 56 is attached to the exterior surface 48 to provide an attachment point for a heat slug (not shown) used to enhance dissipation of heat from the package 40. The braze band 56 should form a continuous surface with an edge 58 of the sidewall 44A adjacent to the exterior surface 48. This continuous surface cannot be obtained when the undesirable material 46 is present.

FIG. 4 illustrates the burnisher 10 in a flexed state to urge it into contact with the undesirable material (not shown). Initially, the burnisher 10 (shown in phantom) was parallel to the sidewalls 44. The burnisher 10 is inserted into the cavity 42 spaced from the sidewalls 44 with the lead section 22 being inserted first so that the cover 24 protects the package 40 from damage if accidental contact of the burnisher 10 with the package 40 occurs. After insertion, the burnisher 10 is moved in the direction indicated by arrow "A" towards the sidewalls 44 causing the burnishing medium 18 to momentarily contact the sidewall 44A before the burnisher 10 flexes. Flexing moves the burnishing medium 18 out of contact with the sidewall 44A so that contact is substantially limited to the undesirable material and a corner 60 where the sidewall 44A and the exterior surface 48 meet. When the burnisher 10 is in the flexed state, the burnisher 10 is moved about the circumference of the cavity to disassociate the undesirable material from the package 40. Flexing results in the burnishing medium 18 being spaced from the sidewall 44A, the burnishing medium 18 being in contact with the undesirable material or corner 60 and a force being generated that is effective to cause disassociation of the undesirable material but not the desirable material, i. e., the undesirable material is disassociated but underlying material is not appreciably removed from the corner 60. After removal of the undesirable material, the sidewall 44A is substantially perpendicular to the exterior surface 48 so that when a heat slug (not shown) is brazed to the exterior surface 48 a continuous surface with the sidewall 44A is formed by the braze fillet.

The term "disassociate", as used in its various grammatical forms, means both removal during the process of moving the burnisher over the undesirable material and loosening during the moving process with removal being assisted by an additional force such as an air stream, brushing or vacuuming.

Positioning the burnishing medium 18 away from the sidewalls 44 results in the sidewall 44 and the wire pads 52 not being rubbed by the burnishing medium 18. Therefore, the sidewalls 44 and wire pads 52 are not likely to be damaged by the burnishing medium.

The burnisher 10 can also be used to shape the cavity or package such as, for example, by rounding off the corner 60. Shaping can be accomplished by making multiple passes over the corner 60 with the burnishing medium 18 at various angles to the sidewall 44A.

Figure 5:
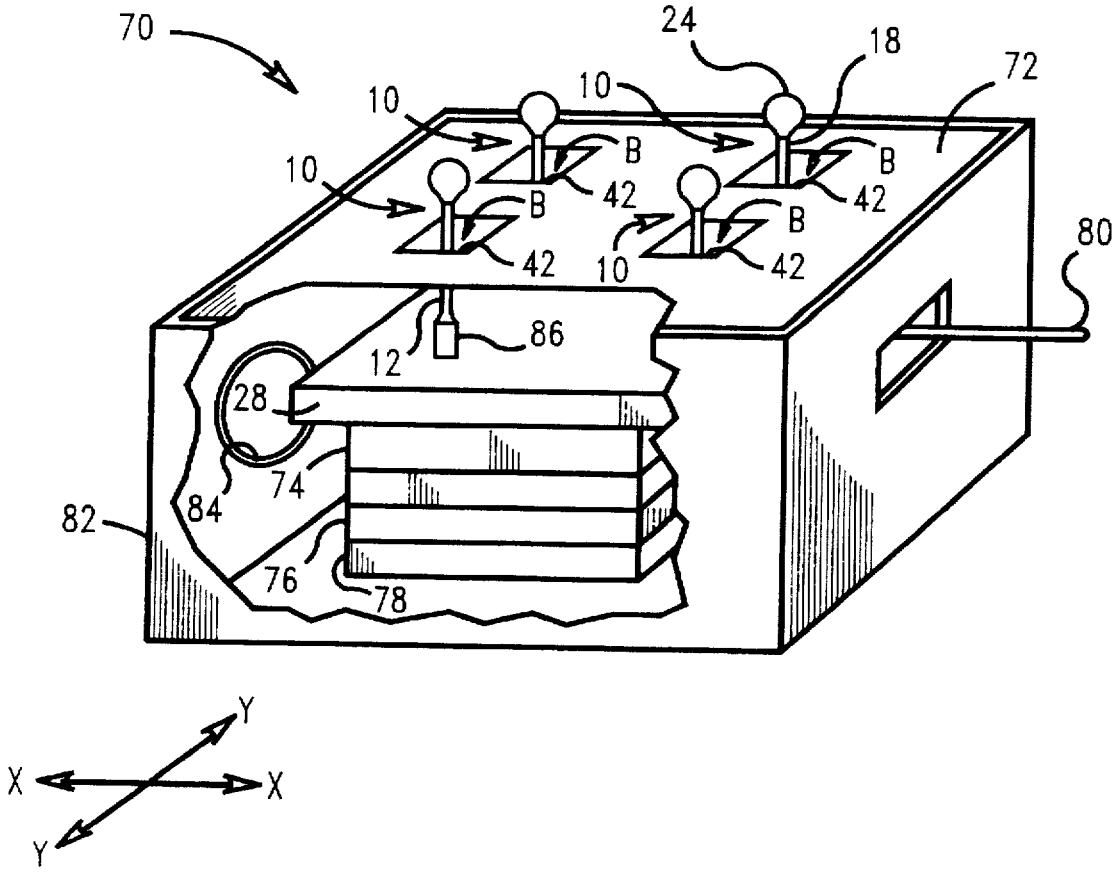
FIG. 5 is a side perspective view of a burnishing apparatus for burnishing multiple work pieces simultaneously.

The burnisher is particularly useful when packages are in a multiple-up arrangement. FIG. 5 illustrates a burnishing apparatus 70 having a 4-up 72 arrangement of four packages therein. For clarity, only the cavity 42 of each package is shown in the 4-up 72. Within the burnishing apparatus 70 is the base 28 having four burnishers 10 mounted thereon. The base 28 is mounted on first platform 74 which is mounted on second platform 76 which is mounted on fixed support 78. Rod 80 is operably associated with the base 28. One of the first or the second platforms 72, 74 permits the base 28 to move in the Y direction and the other permits the base 28 to move in the X direction (see the XY arrows). Movement of the rod 80 in the X or Y direction causes the base 28 to also move in that direction. The rod 80 can be moved manually or automatically. When the rod 80 is moved manually, a guide (not shown) can be used to control the distance the base 28, and hence the burnishers 10, travel in the X and Y direction.

In operation, one of the four burnishers 10 is inserted into each one of the cavities 42. The base 28 is moved in the X or Y direction to place the burnishing medium 18 in contact with the undesirable material or corner and to move the burnishing medium 18 away from the sidewall (see. FIG. 4). The base 28 is then moved to trace out a shape similar to that of the cavities 42. e.g., a square or circle, but larger than the cavities 42 to maintain the burnishers 10 in a flexed state and maintain the burnishing medium 18 in contact with the undesirable material or corner. The flexibility of the burnishers 10 compensates for variations in the relative positions of the cavities 42 or their size.

The burnishing apparatus 70 has a lower portion 82 that is substantially enclosed. One of the side walls of the lower portion 82 includes an opening 84 to which a reduced pressure apparatus (not shown) is attached. Since the lower portion 82 is substantially enclosed, most of the air drawn by the reduced pressure apparatus must flow through the cavities 42 as indicated by the arrows labeled "B", albeit some air can flow through the opening through which the rod 80 passes. The air flowing through the cavities 42 ensures that debris created by the burnishers 10 flows downward away from the package so that the debris does not damage or cover the pin pads, wire pads or other elements of the package. If the burnishers 10 only loosen the undesirable material, the air aids in its removal.

To facilitate disassociation, the burnisher 10 can include a motor or vibrator schematically represented by box 86 for imparting motion to the burnisher 10. The motor imparts rotational or reciprocal motion to the burnisher 10. The box 86 can also represent a heating device that heats the burnisher 10.

If the burnishing medium is attached to the surface of the wire, the wire is flexible. If the burnishing medium is attached to the distal end of the wire, at least one of the wire and the burnishing medium is flexible. The flexible wire or burnishing medium has sufficient rigidity so that the burnisher can stand erect and is configured to provide the flexibility necessary to permit the burnishing medium to move out of contact with the sidewall and generate the force necessary to disassociate the undesirable material. The other of the wire and the burnishing medium can be inflexible. Preferably, the wire is flexible and the burnishing medium is inflexible. The force applied by the burnisher can be adjusted by varying the diameter, length or composition of the wire or burnishing medium. The force can also be adjusted by changing amount of overtravel and thereby the amount of flex.

The wire is preferably made of spring steel, piano wire or the like.

The burnishing medium is effective at disassociating the undesirable material and preferably has a long service life. Representative burnishing media are carbide, ceramic, diamond coatings and the like whose particle size and shape is selected for the intended material to be disassociated. When the package is made from ceramic, the burnishing medium is preferably a tungsten carbide. The burnishing medium is preferably in the shape of a round wire or thin rod whose diameter is preferably small enough so that the burnishing medium can fit into tight corners. For many applications, a burnishing medium having a diameter of about 0.1 to about 0.5 mm is sufficient. The diameter of the burnishing medium is not as critical when the undesirable material is on an external surface as opposed to a cavity or when the burnisher is used to cut heavy undesirable material from the package. In additional embodiments, the burnishing medium can have a fluted, circumferential groove or like shape.

The package is preferably made of a ceramic material and can be laminated or cast.

It presently is theorized that the above-described advantages are achieved because the flexibility of the burnisher permits the burnishing medium to disassociate only the undesirable material and not the desirable material.

The burnisher of the present invention has been described herein in connection with a ceramic package. It will be understood to one skilled in the art that the burnisher has uses in connection with other work pieces.

This invention has been described in terms of specific embodiments set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

We claim:

1. A flexible wire burnisher for disassociating undesirable material from a work piece, comprising:

a wire having a distal end, a proximate end, a lead section and an outer surface, wherein the wire is capable of flexing, the lead section is adjoining the distal end, the outer surface is capable of contacting the work piece in the region between the lead section and the proximate end, and the lead section is capable of preventing an abrasive action of the wire and the work piece outside the region between the distal end and the proximate end of the wire; and a burnishing medium in contact with the wire over at least the region capable of contacting the work piece, the burnishing medium is capable of disassociating undesirable material.

2. The burnisher according to claim 1 further comprising means for protecting, the protecting means covering at least a portion of the lead section of the wire.

3. The burnisher according to claim 1 further comprising means for imparting motion to the burnisher.

4. The burnisher according to claim 3 wherein the motion imparting means is capable of urging the burnisher into contact with the work piece along a horizontal-vertical plane.

5. The burnisher according to claim 1 wherein the burnishing medium is in contact with outer surface of the wire.

6. The burnisher according to claim 1 further comprising a base to which the proximate end of the wire is attached.

7. The burnisher according to claim 1 wherein the burnishing medium is in the shape of a thin rod.

8. A flexible wire burnisher for disassociating undesirable material from a work piece, comprising:

a wire having a distal end and a proximate end;

a burnishing medium having a lead section, a distal end and a proximate end, wherein the proximate end of the burnishing medium is adjacent to the distal end of the wire, the lead section is adjoining the distal end of the burnishing medium, the lead section is capable of preventing abrasive action between the burnishing medium and the workpiece outside of the region between the lead section and the proximate end of the burnishing medium, the burnishing medium is capable of contacting the work piece in the region between the lead section and the proximate end of the burnishing medium, and at least one of the wire and the burnishing medium is flexible.

9. The burnisher according to claim 8 wherein the wire is flexible.

10. The burnisher according to claim 8 wherein the burnishing medium is tungsten carbide and the wire is piano wire.

11. The burnisher according to claim 8 wherein the burnishing medium is in the shape of a thin rod.

12. A cantilever burnisher for disassociating undesirable material from a work piece, comprising:

a base;

at least one flexible wire, the wire having a proximate end, a distal end, a lead section and an outer surface, wherein the proximate end is in communication with the base, the lead section is adjoining the distal end, the lead section is capable of preventing an abrasive action between the wire and the work piece outside of the region between the distal end and the proximate end, the outer surface is capable of contacting the work piece in the region between the lead section and the proximate end, the wire is extending outwardly from the base; and a burnishing medium, in contact with the wire over at least the region capable of contacting the work piece, the burnishing medium being capable of disassociating undesirable material.

13. The burnisher according to claim 12 further comprising means for protecting, the protecting means covering at least a portion of the lead section of the wire.

14. A flexible burnisher for disassociating undesirable material from a work piece having a cavity, comprising:

a base;

a burnishing medium having a distal end, a lead section, and a proximate end, wherein the lead section is adjoining the distal end, the lead section is capable of preventing abrasive action between the burnishing medium and the workpiece outside of the region between the lead section and the proximate end, the burnishing medium is capable of contacting the work piece in the region between the lead section and the proximate end, the burnishing medium is also capable of disassociating material from the work piece; and a means for supporting the burnishing medium extending outwardly from the base.

15. The burnisher of claim 14 further comprising means for positioning the burnishing medium within the cavity of the work piece wherein at least one of the position or size of the cavity is variable.

16. The burnisher according to claim 14 further comprising at least two support means each having a burnishing medium capable of contacting the work piece in the region between the lead section and the proximate end, and means for aligning the burnishing mediums in the cavities of the work piece, wherein the aligning means is capable of compensating for variations in the relative position of the cavities to one another.

17. The burnisher according to claim 16 wherein each of the cavities contains at most one burnishing medium.

18. A flexible wire burnisher for disassociating undesirable material from a work piece, comprising:

a wire having a distal end, a proximate end and an outer surface, wherein the wire is capable of flexing, the outer surface is capable of contacting the work piece in the region between the distal end and the proximate end; and a burnishing medium in contact with the outer surface over at least the region capable of contacting the work piece, the burnishing medium being capable of disassociating undesirable material.

19. The burnisher according to claim 18 further comprising a lead section adjoining the distal end of the burnishing medium, the lead section capable of preventing abrasive action between the burnishing medium and the workpiece outside of the region between the lead section and the proximate end.

20. A flexible wire burnisher for disassociating undesirable material from a work piece, comprising:

a wire having a distal end and a proximate end;

a burnishing medium having a distal end and a proximate end, wherein the proximate end of burnishing medium is in contact with the distal end of the wire, the burnishing medium is capable of contacting the work piece in the region between the distal end and the proximate end of the burnishing medium, and at least one of the wire and the burnishing medium is flexible.

21. The burnisher according to claim 20 further comprising a lead section adjoining the terminus of the distal end of the burnishing medium, wherein the lead section is capable of preventing abrasive action between the burnishing medium and the workpiece outside of the region between the lead section and the proximate end.

* * * * *